United States Patent [19]

Silvander

[11] 4,272,875

[45] Jun. 16, 1981

[54] DEVICE TO ALIGN THE END FITTINGS IN THE CASTING OF CONCRETE PILES

[76] Inventor: Frank O. Silvander, Richertsgatan 10, S-412 50 Göteborg, Sweden

[21] Appl. No.: 70,180

[22] Filed: Aug. 27, 1979

[30] Foreign Application Priority Data

Jun. 12, 1979 [SE] Sweden ..... 7905155

[51] Int. Cl.[3] ..... B25B 27/14

[52] U.S. Cl. ..... 29/271

[58] Field of Search ..... 29/258, 271

[56] References Cited

U.S. PATENT DOCUMENTS

| | | | |
|---|---|---|---|
| 2,799,083 | 7/1957 | Speers | 29/271 |
| 3,240,472 | 3/1966 | Jones | 29/271 X |
| 3,541,665 | 11/1970 | Ferris, Sr. | 29/258 X |

*Primary Examiner*—James G. Smith

*Attorney, Agent, or Firm*—Harness, Dickey & Pierce

[57] ABSTRACT

A device for use in casting concrete piles in a mold consisting of a bottom section and two side walls. The piles are formed with lengthwise reinforcement rods, on the ends of which are attached interconnecting members passing through the end fittings of the pile. The device is characterized by an alignment member arranged to be positioned in the mold. Abutment faces on the alignment member are arranged in engagement with the side walls and the bottom section of the mold at right angles to the longitudinal extension thereof. The alignment member is provided with shoulders forming points of abutment for engagement with the ends of the interconnecting members. A pulling means is arranged to engage in the center of said end fitting members and with the aid of a support means provided in said alignment member to urge the ends of the interconnecting members into abutment against the shoulders of the alignment member, when said tightening means is tightened. The device facilitates alignment of the end fitting members in an exactly right-angled position to the longitudinal direction of the mold and ensures that the aligned relationship is maintained throughout the entire casting operation.

2 Claims, 3 Drawing Figures

DEVICE TO ALIGN THE END FITTINGS IN THE CASTING OF CONCRETE PILES

BACKGROUND OF THE INVENTION

The subject invention relates to a device which is designed to align the end fittings of concrete piles to be cast in elongate molds of the kind comprising a bottom section and two side walls. Concrete piles of this kind are intended to be manufactured with lengthwise extending reinforcement rods, the ends of which are provided with interconnecting members which pass through the end fittings.

In accordance with the conventional technique of manufacturing concrete piles of this kind molds are used which have a sufficient length to ensure that several piles may be cast simultaneously in the same mold. In the casting operation, the end fittings of the piles serve as the partitions and end walls of the mold, separating the individual piles from one another.

Prior to casting, a framework comprising longitudinally extending reinforcement rods is made and a wire is wound about these rods to form a reinforcement cage. Interconnecting members are screwed onto the ends of the reinforcement rods, which members extend through the end fittings and serve to interconnect two concrete piles in end-to-end positions, when the piles are to be driven down into the ground.

Before fixation of the end fittings in the mold, the alignment of the end fittings in the transverse direction of the lengthwise extension of the mold was in the past carried out by eye. The end fittings were thereafter secured in position with the aid of securing members in the form of blocks which were deposited in abutting position against the external face of the end fittings in the mold and retained in position by wedging means.

However, it has turned out in practice that when the concrete has been filled into the mold and allowed to set, the end fittings of the piles still did not assume a position at exact right angles to the longitudinal extension of the piles. Angular deviations in the joint between two piles in end-to-end position increase the risk of the piles bending while they are being driven down into the ground and in addition, such deviations cause uneven distribution of the tensile forces occuring in the lengthwise reinforcement rods in between the rammer blows.

The subject invention has been conceived with a view to make it possible to cast piles while ensuring high precision of the angular position of the pile end fittings.

SUMMARY OF THE INVENTION

In accordance with the teachings of the subject invention, the end fitting alignment device comprises an anlignment member arranged to be positioned in the mold and having faces thereon which faces abut against the side and bottom walls of the mold at right angles to the lengthwise extension of the mold, said anlignment member also having shoulders thereon serving as points of abutment against the ends of the interconnecting members, the device further comprising a pulling member, said member arranged to engage the centre of the end fitting and, when it is being tightened, to exert a pressure against a support means in said alignment member, thereby bringing the ends of the interconnecting members into abutment against the shoulders of said alignment member.

In accordance with a preferred embodiment the alignment member consists of two plates arranged in parallel and interconnected by rods, the ends of which form said shoulders on one side of said alignment member, and the pulling member consists of a threaded bolt passing through the support means and formed with a non-round transverse disc which is arranged to be inserted through a non-round aperture formed in the centre of said end fitting and to be locked behind the latter, and of a tightening nut which is arranged to be pulled in the direction towards said support means from that side of said transverse disc that is opposite said support means.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 2:
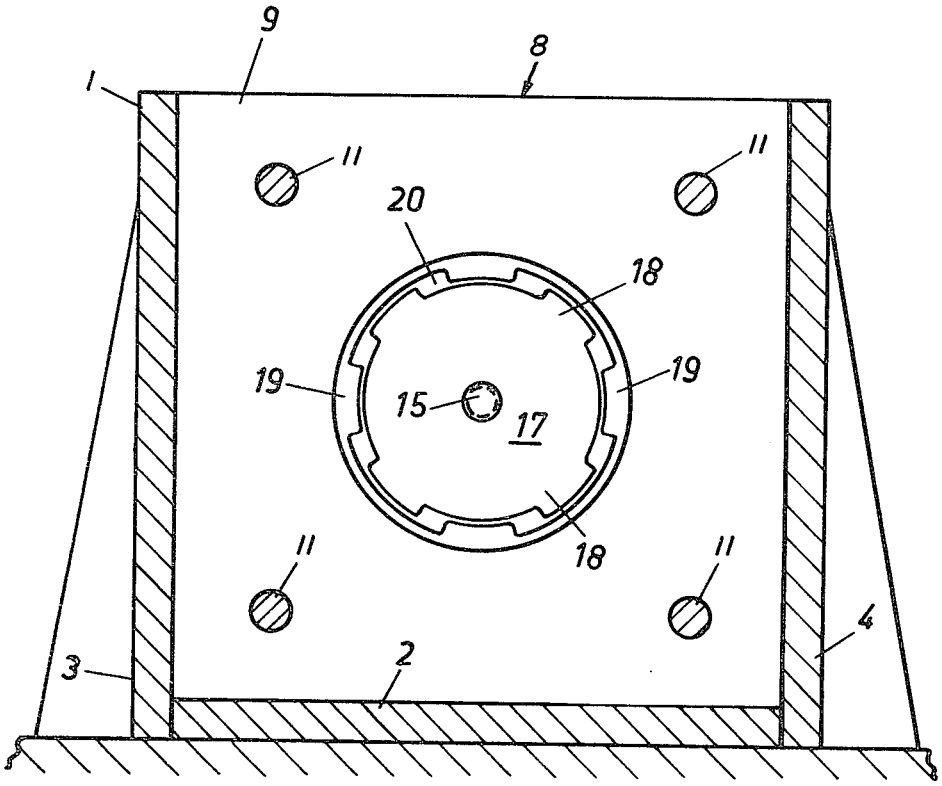
FIG. 2 is a cross-sectional view along line II—II of FIG. 1.

The mold 1 comprises a bottom section 2 and the two side walls 3 and 4, as appears from FIG. 2. Inside the mold, transversely as seen in the lengthwise direction thereof, is positioned an end fitting 5 through which extend interconnecting members 6 (four such members being used in the shown embodiment). These interconnecting members 6 serve as attachment means to four reinforcement rods 7 extending through the mold and are screwed onto these rods. By regulating the extent to which these interconnecting members 6 are screwed onto the reinforcement rods 7 it is possible to effect a rough adjustment of the position of the end fitting 5 to ensure that it is essentially transverse to the longitudinal extension of the mold 1.

The device in accordance with the subject invention consists of an alignment member 8 which is placed inside the mold adjacent the end fitting 5. The alignment member 8 consists of two plates 9, 10 which are positioned to ensure that three of their edge faces abut against the bottom section 2 and the side walls 3 and 4 of the mold. The plates 9, 10 are interconnected by four spacer bars 11. At the side of the alignment member facing the end fitting 5 the ends of the spacer bars 11 form shoulders 12, arranged to abut against the ends of the interconnecting members 6.

The alignment member 8 is furthermore provided with a centrally located pulling means 13. The latter extends through an intermediate plate 14 serving as a support means. In accordance with the embodiment illustrated in the drawings the pulling means consists of a threaded bolt 15 with a tightening nut 16 thereon and is formed with a transverse disc 17 on which lugs 18 are formed. The transverse disc 17 is arranged for insertion through a centrally located aperture 20 in the end fitting 5, which aperature is formed with peripheral flanges 19. By means of a bayonet catch the disc 17 may be locked behind the end fitting.

Figure 1:
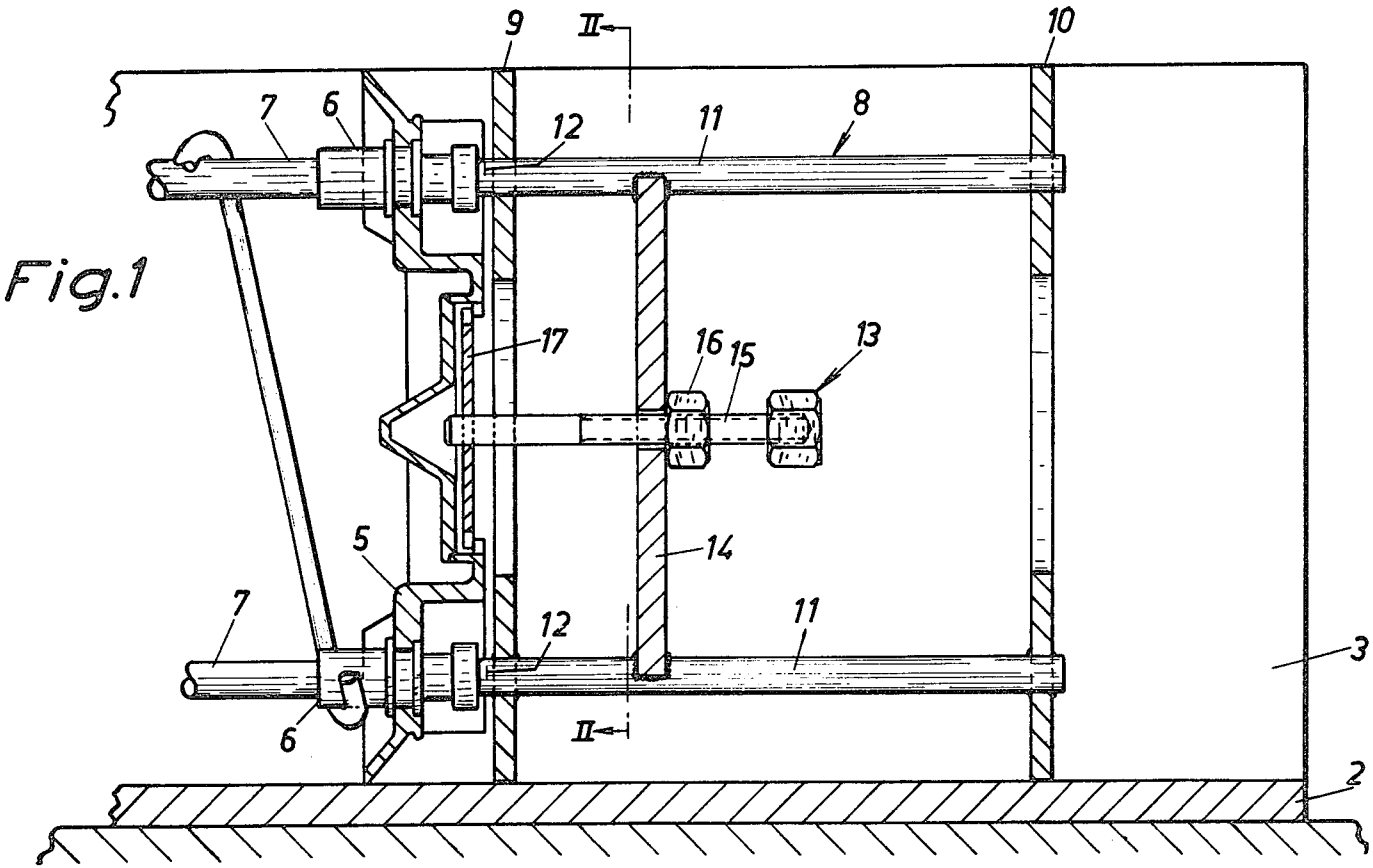
FIG. 1 is a vertical longitudinal section through the device in accordance with the invention.

When an end fitting 5 is to be arranged in its correct position of alignment, the alignment member 8 is placed in the position appearing from FIG. 1 with the shoulders 12 thereof exactly opposite their associated interconnecting members 6. The transverse disc 17 on the bolt 15 is inserted through the aperture 20 and turned, allowing the lugs 18 to engage behind the flanges 19. The bolt 15 may now be tightened with the aid of the tightening nut 16. Should the end fitting 5 assume a somewhat oblique position in any direction, its position is automatically adjusted during the tightening of the bolt 15 until each interconnecting member 6 exerts a pressure against its associated shoulder 12. Owing to the exact and correct angular position of the alignment member 8 inside the mold 1, also the end fitting 5 will assume a correct angular position therein at right angles to the lengthwise extension of the mold.

The alignment of the end fitting is effected in a corresponding manner at the opposite end of the pile to be cast.

Figure 3:
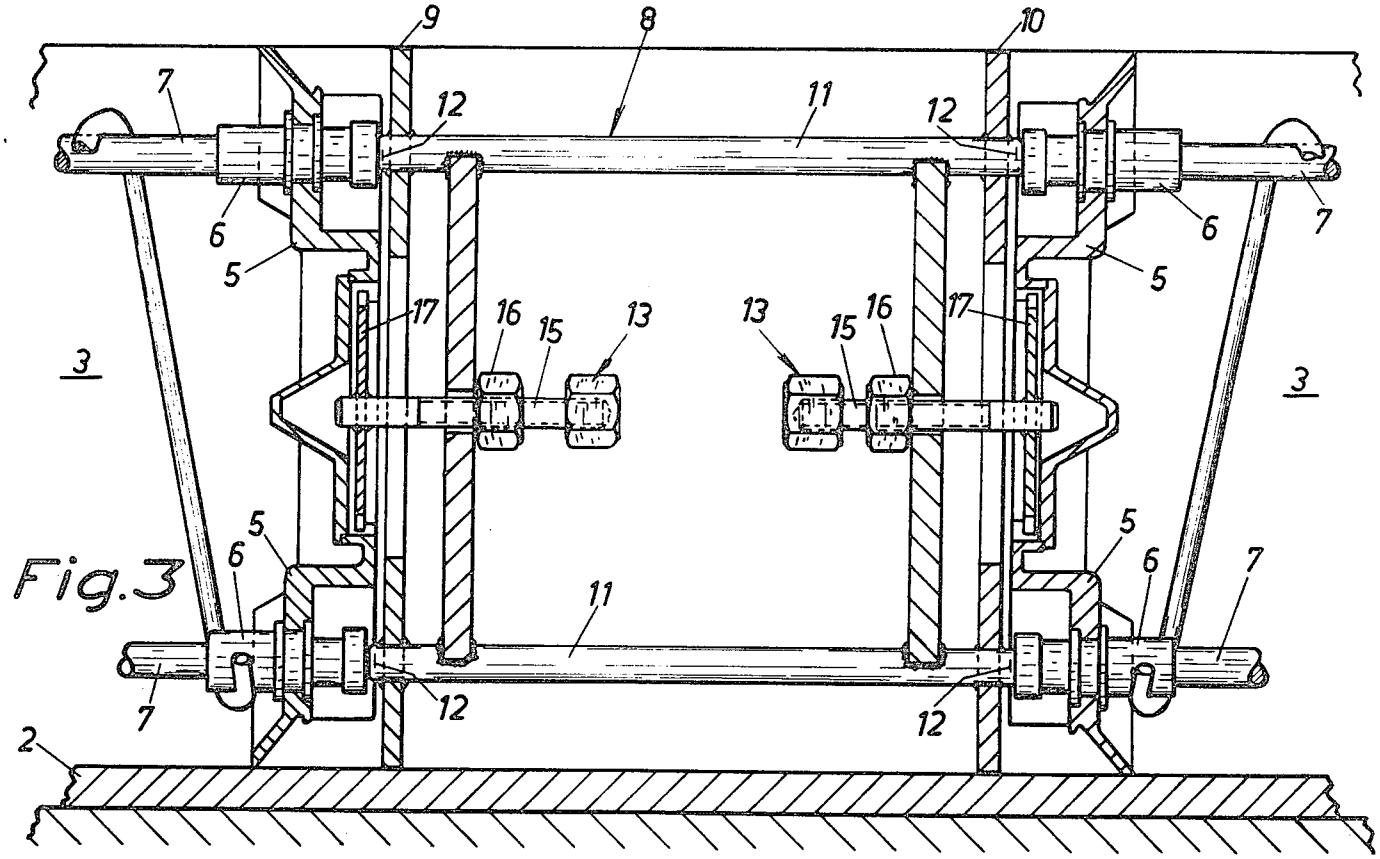
FIG. 3 is a vertical longitudinal section through an alternative embodiment of the device in accordance with the invention.

FIG. 3 illustrates an embodiment of the invention comprising a double alignment member. The latter is provided with two identical alignment means positioned in a mirror-image fashion and is intended to be used when several piles positioned in endwise relationship are to be cast simultaneously.

The invention is not limited to the embodiments as described and illustrated in the drawings but several modifications thereof are possible within the scope of the appended claims. For instance, the pulling member 13 may be designed in a number of various ways, the essential feature being that its pulling force is effected on the central part of the end fitting 5.

In addition, the alignment member 8 may have a design differring from the one illustrated, provided its abutment against the inner walls of the mold 1 is satisfactory. It should preferably have a markedly elongate shaped.

What I claim is:

1. An improved device designed to align the end fittings of concrete piles of the kind to be cast in elongate molds comprising a bottom section and two side walls, and having lengthwise extending reinforcement rods therein, the ends of which are provided with interconnecting members passing through the end fittings, the improvement comprising an alignment member arranged to be positioned in said mold, said alignment member having faces spaced for positioning in abutting relationship with the bottom section and side walls of the mold at right angles to the lengthwise extension of the mold for locating said alignment member relative to the mold, shoulders on said alignment member, said shoulders being juxtaposed to the interconnecting members when said alignment member is positioned in the mold for serving as points of abutment against the ends of the interconnecting members, and a pulling member having means for providing a connection to the end fitting a support means in said alignment member, said pulling member being interconnected to said support means for exerting a pressure against said support means when tensioned for bringing the ends of the interconnecting member into abutment against said shoulders of said alignment member.

2. The device as claimed in claim 1, wherein the alignment members comprise two plates, said two plates arranged in parallel and interconnected by rods, the ends of said rods forming said shoulders on one side of said alignment member, a threaded bolt forming said pulling member, said threaded bolt passing through said support means and provided with a non-round transversely extending disc, said disc arranged to be inserted through a non-round aperture formed in the centre of said end fitting so as to be locked behind the latter, and a tightening nut arranged to be pulled in the direction towards said spport means from that side of said transverse disc that is opposite said support means.

* * * * *